US009202391B1

(12) United States Patent
Nelson

(10) Patent No.: US 9,202,391 B1
(45) Date of Patent: Dec. 1, 2015

(54) MUSICAL CHAIR GREETING CARD

(71) Applicant: American Greetings Corporation, Cleveland, OH (US)

(72) Inventor: Gary Nelson, Avon, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/748,594

(22) Filed: Jun. 24, 2015

(51) Int. Cl.
*G09F 1/08* (2006.01)
*B42D 15/02* (2006.01)
*B42D 15/04* (2006.01)

(52) U.S. Cl.
CPC ..... *G09F 1/08* (2013.01); *B42D 15/022* (2013.01); *B42D 15/045* (2013.01)

(58) Field of Classification Search
CPC ..... G09F 1/08; B42D 15/022; B42D 15/045
See application file for complete search history.

(56) References Cited

U.S. PATENT DOCUMENTS

| | | | | |
|---|---|---|---|---|
| 3,702,034 | A * | 11/1972 | Pfeiffer | 40/320 |
| 8,973,292 | B1 * | 3/2015 | Shlonsky et al. | 40/124.03 |
| 2002/0116846 | A1 * | 8/2002 | Wu | 40/320 |
| 2003/0188468 | A1 * | 10/2003 | Tahan | 40/538 |
| 2009/0038187 | A1 * | 2/2009 | Moy | 40/411 |
| 2009/0126239 | A1 * | 5/2009 | Clegg | 40/124.03 |
| 2012/0005928 | A1 * | 1/2012 | Ella | 40/320 |

* cited by examiner

*Primary Examiner* — Gary Hoge
(74) *Attorney, Agent, or Firm* — Christine Flanagan

(57) ABSTRACT

The present disclosure and related inventions is directed to a three-dimensional (3D) greeting card. The greeting card is shaped like a chair which folds and unfolds and which plays audio upon interaction with the greeting card by a user. It also contains a miniature greeting card attached to the seat portion of the chair to provide a user with space for writing a message or adding his/her signature.

20 Claims, 6 Drawing Sheets

MUSICAL CHAIR GREETING CARD

RELATED APPLICATIONS

There are no applications related to this application.

FIELD OF THE INVENTION

The present invention is in the field of social expression products and more specifically to an interactive keepsake greeting card with audio capabilities.

SUMMARY OF THE INVENTION

The present disclosure and related inventions is directed to a three-dimensional (3D) greeting card. The greeting card is shaped like a chair which folds and unfolds and which plays audio upon interaction with the greeting card by a user. It also contains a miniature greeting card attached to the seat portion of the chair to provide a user with space for writing a message or adding his/her signature.

DETAILED DESCRIPTION OF PREFERRED AND ALTERNATE EMBODIMENTS

The greeting card of the present invention is a three-dimensional (3D) model of a folding chair (also known as a lawn chair or outdoor lounge chair) that operates as a greeting card. The greeting card includes a chair frame, two arm rests and a covering or planar sheet material which overlies portions of the chair frame. Text sentiment and other printing and/or embellishments may be attached to the covering or planar sheet material. The greeting card can be used to convey sentiment to a recipient on a special occasion and it also serves as a small token or keepsake that can be retained by the recipient after the special occasion.

Figure 3:
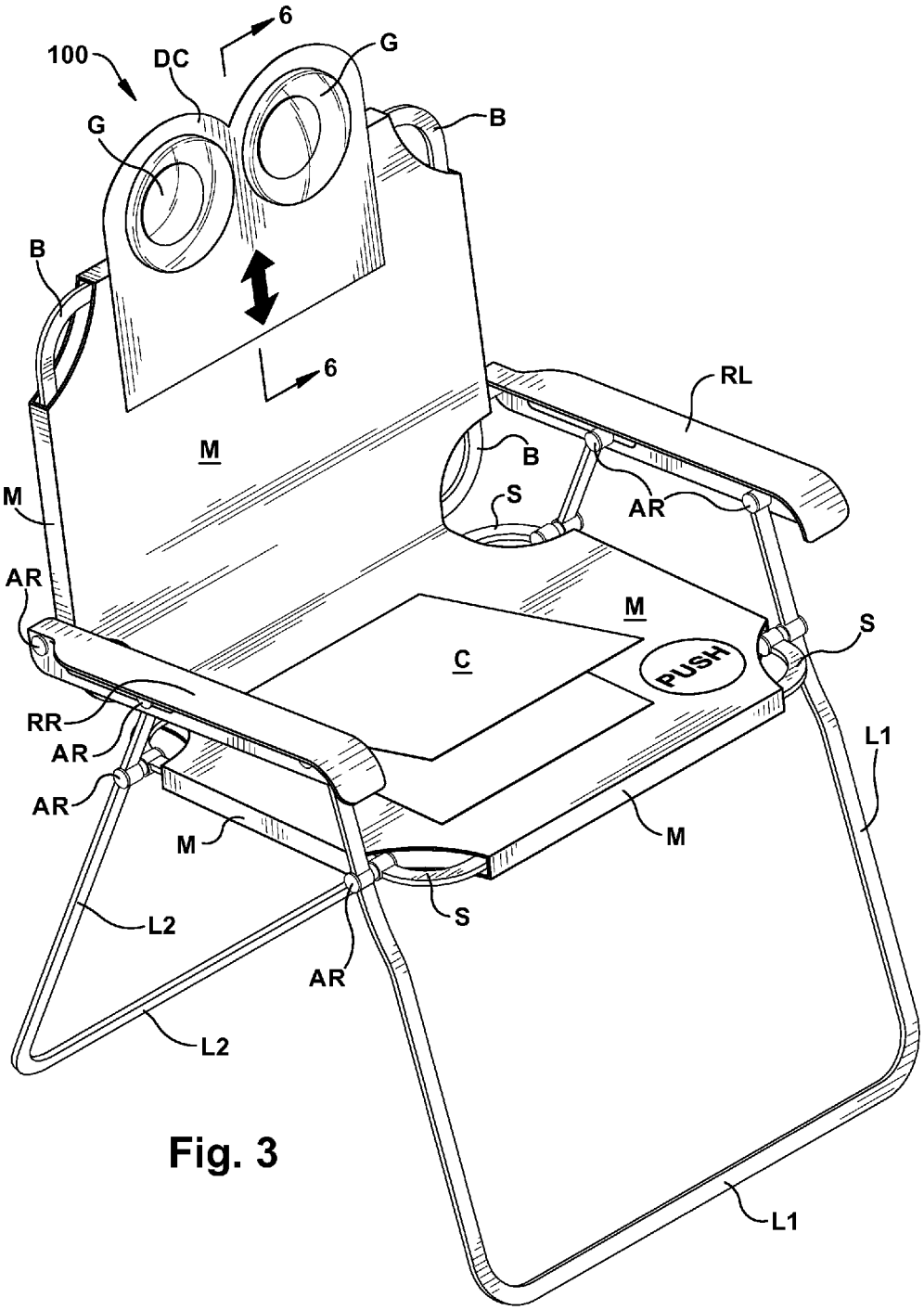
FIG. 3 is a perspective view of the greeting card of FIG. 1, in an unfolded or open position.

The greeting card 100 is made up of a chair frame and a planar sheet material or covering M which overlies portions of the chair frame. The chair frame contains various interconnected segments or parts which combine to form a miniature chair. The various segments or parts of the chair frame are mechanically arranged so that the chair can move from a first position, shown in FIG. 1, wherein it is folded relatively flat with the seat portion S folded or collapsed atop the back portion B of the chair with all segments in a relatively parallel arrangement, and a second position, shown in FIG. 3, wherein it is unfolded into a standing upright position with the seat portion S perpendicular and at a substantially right angle to the back portion B and with the two leg portions L1, L2 perpendicular and at substantially right angles to the seat portion S and substantially parallel to the back portion B.

The two leg portions L1, L2 of the chair frame are u-shaped legs which serve as the support for the greeting card 100 when unfolded and placed in an upright position. The two u-shaped legs L1, L2 each have two sets of connection points or openings wherein they are rotatably or pivotably attached to the seat portion S of the chair frame and also to the two arm rests RR, RL. The first set of connection points are located at each distal end of the u-shaped legs L1, L2 at the top of the two vertical portions of the legs. The set first connection points are used to attach the two u-shaped legs L1, L2 to the two arm rests RR, RL, via an attachment rod AR (described in further detail below). The set second connection points are located in an upper region of the two vertical portions of the legs L1, L2, approximately 1-inch below the distal ends and the first set of connection points. The second set of connection points are used to attach the two u-shaped legs L1, L2 to the seat portion S of the chair frame, via an attachment rod AR (described in further detail below). Each of the u-shaped legs L1, L2 are made of a single, contiguous piece of material but can be made of separate segments. In a preferred embodiment, the two u-shaped leg portions L1, L2 of the chair frame are made of plastic, however, other material may be used.

The seat S and back B portions of the chair frame are each four-sided, substantially square-shaped structures with two vertical segments connected at each end two horizontal segments. The seat portion S contains two sets of attachment points or openings, a first set of attachment points located near the upper end of each vertical segment and a second set of attachment points located near the lower end of each vertical segment. The first set of attachment points are used to connect the seat portion S to a first leg L1 and the second set of attachment points are used to connect the seat portion S to a second leg L2, both via an attachment rod AR (discussed in further detail below). The seat S and back B portions of the chair frame are each made of a single contiguous piece of material, however, they can be made of more than one segment of material. In a preferred embodiment, the seat S and back B portions of the chair frame are made of plastic, however, other materials may be used.

The back portion B of the chair frame contains a single set of attachment points (not shown) located near the lower end of each vertical segment. These attachment points are used to connect the back portion B of the chair frame to the two arm rests RR, RL. The two arm rests RR, RL have a relatively flat, planar upper portion which slightly curve downward at one of the distal ends thereof. A perpendicular segment vertically bisects the flat, planar upper portion on a lower surface thereof. The perpendicular segment of each arm rest have a first opening at a rear distal end, a second opening near the opposite distal end (near the curved section) and an elongate slot located RRS, RLS near the opening at the rear distal end. The first opening is used to attach the arm rest RR, RL to a first leg L1 via an attachment rod AR (discussed in further detail below), the second opening is used to attach the arm rest RR, RL to the back portion B of the chair frame, via an attachment rod AR (discussed in further detail below) and the elongate slot RRS, RLS is used to attach the arm rest RR, RL to the second leg L2. The slot RRS, RLS is approximately 1-inch in length and facilitates movement of the chair between the first (folded) position and the second (unfolded) position by enabling the rear legs L2 of the chair frame to slide along the length of the slot RRS, RLS and change the angle of the rear legs L2 with respect to the seat portion S and the arm rests RR, RL. In a preferred embodiment, the back portion B of the chair frame is made of plastic, however, other materials may be used.

A plurality of attachment rods AR are used to connect the various parts or segments of the chair frame. Each attachment rod AR contains a circular bar or shaft with two circular, disk-shaped portions at each end, similar to the shape of a barbell. The bar or shaft portion is sized such that it can be inserted into the openings or attachment points located on the various parts or segments of the chair frame. The circular, disk-shaped portions at the opposing ends of each attachment rod have a larger diameter than the openings or attachment points located on the various parts or segments of the chair frame so that they retain two attached or connected segments of the chair frame between the two ends or circular, disk-shaped portions of the attachment rods, while still allowing the connected segments to rotate or pivot with respect to one another. Two attachment rods AR are used to attach the seat portion S of the chair frame to the first u-shaped leg portion L1 (one on each side), two attachment rods AR are used to attach the seat portion S to the second u-shaped leg portion L2 (one on each side), two attachment rods AR are used to attach the first u-shaped leg portion L1 to the arm rests RR, RL (one on each side), two attachment rods AR are used to attach the second u-shaped leg portion L2 to the arm rests RR, RL (one on each side), and two attachment rods AR are used to attach the back portion B of the frame to the arm rests RR, RL (one on each side). In a preferred embodiment, the attachment rods AR are made of plastic and are approximately ¼-inch in length, although other materials and sizes may be used. Different sized attachment rods AR may be used for chairs of different scale or size.

Figure 4:
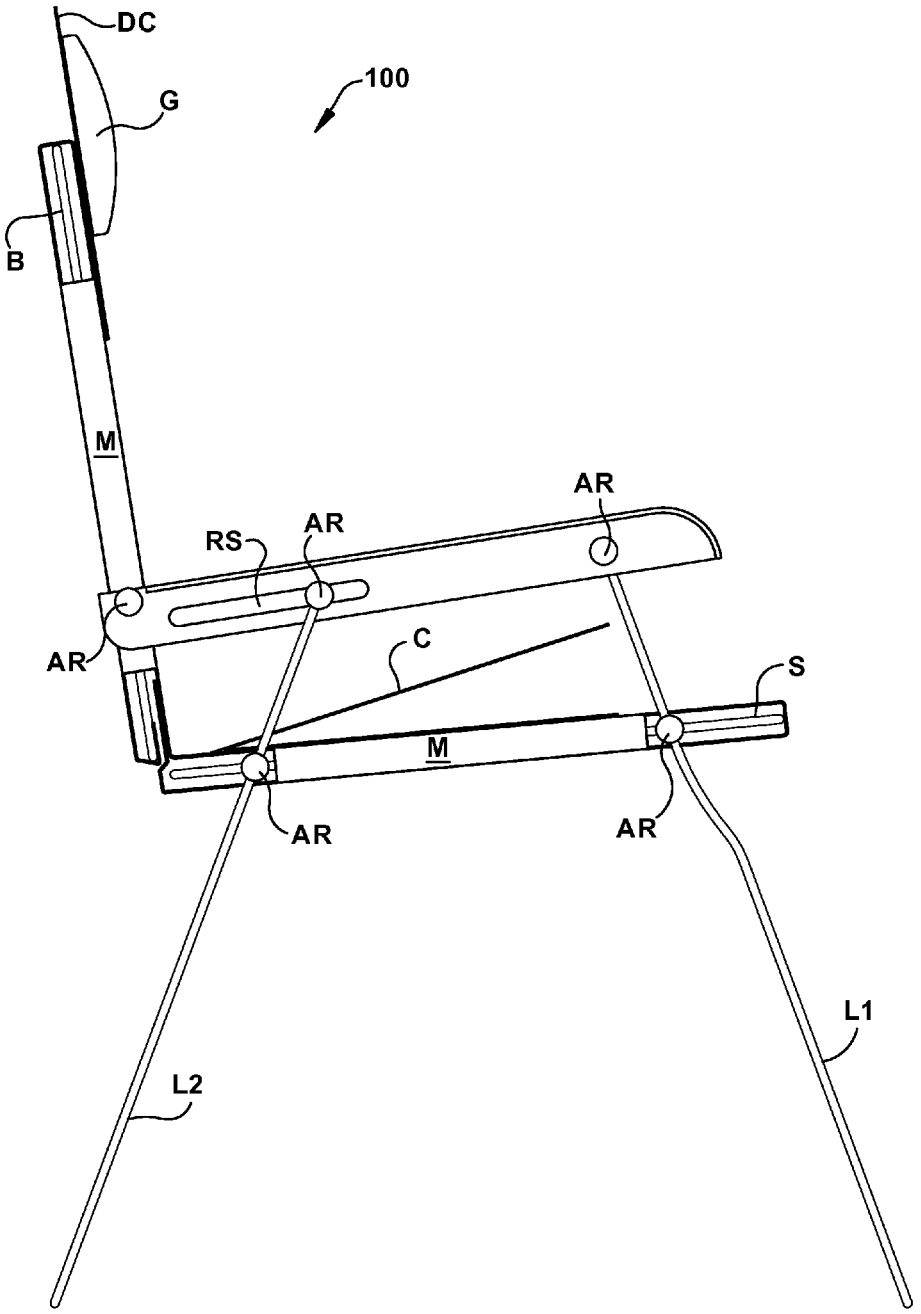
FIG. 4 is a side view of the greeting card of FIG. 3.
Figure 5:
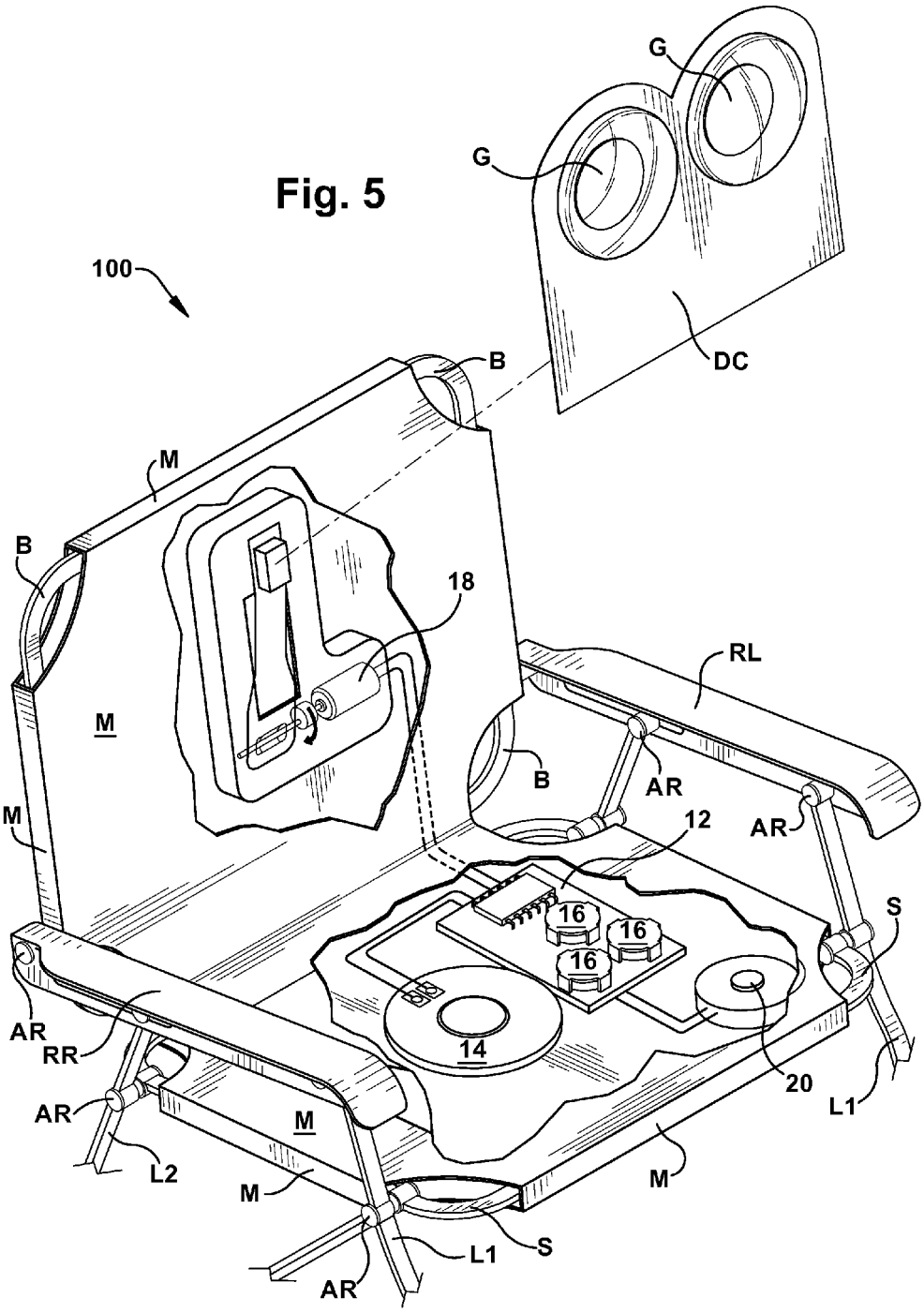
FIG. 5 is a close-up, tear-away view of the greeting card of FIG. 3.
Figure 6:
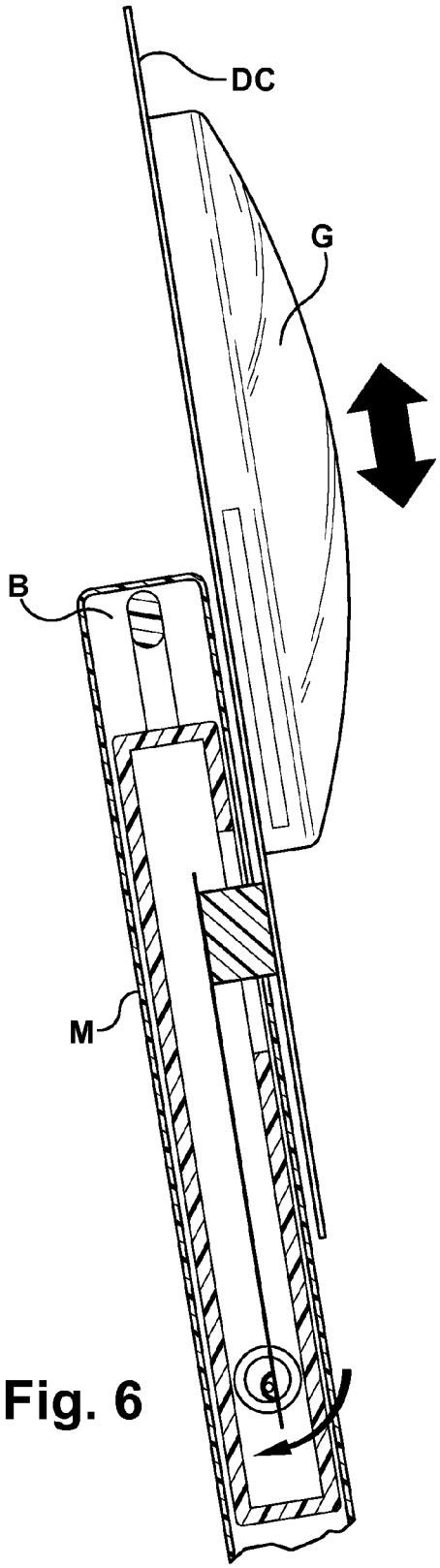
FIG. 6 is a cross-sectional view of the upper back portion of the greeting card of FIG. 3, from the perspective of arrows 6-6.

A covering (also referred to herein as a planar sheet material) M, which in a preferred embodiment is made of paperboard, is attached around the seat S and back B portions of the chair frame. The covering M provides several purposes, such as providing a portion of the chair wherein text sentiment and other printing may be contained thereon, providing a place for greeting card purchasers to write a note or sign their name thereon, further attaching the seat S and back B portions of the chair together, and protecting and concealing the electronic components of the greeting card. The covering M may be made of a single contiguous piece of paperboard with various fold lines or may be comprised of two or more pieces of paperboard which may or may not be connected via adhesive or other attachment mechanism (e.g., staples, rivets, slots/tabs, etc.). As mentioned above, the covering M may be printed with text sentiment and also with drawings, pictures and/or photos. In the example shown in the figures, the covering M contains printing which depicts the look of a traditional lawn chair (like the kind that may be used at an outdoor party or barbeque) and the portion of the covering M which covers the bottom or underside of the seat S portion of the chair frame (which can be seen when the chair is in the folded position) contains text sentiment. The covering M may cover the entire seat S and back B portions of the chair frame or it may cover a substantial portion, as shown in the FIGS. 1, 3 and 5, where the corners of the seat S and back B portions of the chair frame are uncovered. In a preferred embodiment, the covering M is made of paperboard, which can be printed with text sentiment, photos, and drawings and also embellished with items such as googly eyes G, die cut shapes and any other small accessory. The covering M may alternatively be made of plastic, cellophane, cardboard, fabric, or other lightweight printable material. As shown in the FIGS. 3 and 4, a small or miniature card C is attached to the seat S portion of the covering M. The card C is folded like a traditional greeting card and contains text sentiment on the inside surface thereof. There is also room for a user to sign his/her name to the card or to write a small note. Also attached to the covering M is a mobile object in the form of a small die cut shape DC which is printed and embellished to resemble a face having a mustache and googly eyes G (small plastic craft supplies used to imitate eyeballs, typically composed of a white plastic or card backing covered by a clear, hard plastic shell, encapsulating a black plastic disk) attached thereto. The die cut shape DC is attached to the motor 10 through an opening in the covering M. The die cut shape DC may be of the same basic color or have the same or very similar pattern to the color and/or pattern printed on the covering M so that it blends into the background or covering material M and is not initially apparent that it is a moveable object DC separate from the covering M.

The electronic components of the greeting card 100, as mentioned above, are attached to the inside surface of the covering M which envelopes the seat S and back B portions of the chair frame. The electronic components may include, but are not limited to: a printed circuit board and integrated circuit chip 12, a speaker 14, a power source such as one or more batteries 16, a small motor 18, a memory storage device, a switch and related wiring and circuitry. The greeting card may further include any component which is required or which facilitates the storage and playback of audio through the speaker 14, motor movement of a small die cut shape (or other small addition or embellishment) DC, and any other special effect, such as lighting effects. The sound module is operative to store and playback at least one audio file contained on the memory storage device upon activation. The at least one audio file may contain music, a song, a spoken message, a sound effect or noise or any other recordable sound. The sound module may alternatively contain more than one audio file or sound clip and different audio may be played back upon activation of the sound module. The electronic components may be attached to and contained within the covering M over the seat portion S and/or the back portion B of the chair frame. In a preferred embodiment, due to the size of the chair, the circuit board 12 and speaker 14 are contained on the inside surface of the covering M over the seat portion S of the chair frame and the motor 18 is contained on the inside surface of the covering M over the back portion of the chair frame. However, the electronic components may all be placed under the seat S or back B portion, or may be divided between the seat S and back B portion, in any conceivable way. The motor 18 is attached to the die cut shape DC resembling the face of a mustachioed character through an opening in the covering M over the back portion B of the chair frame. When the motor 18 is activated, the die cut shape DC of the character face moves in an up and down or bouncing motion, causing the googly eyes G to move around within the shell. A press-button switch 20 is also located beneath the covering M over the seat portion S of the chair frame. The covering M contains printing thereon which indicates the location of the press-button 20 with the words "press" or "press here" to direct the user to the location where he/she can initiate the audio and motor effects.

Figure 1:
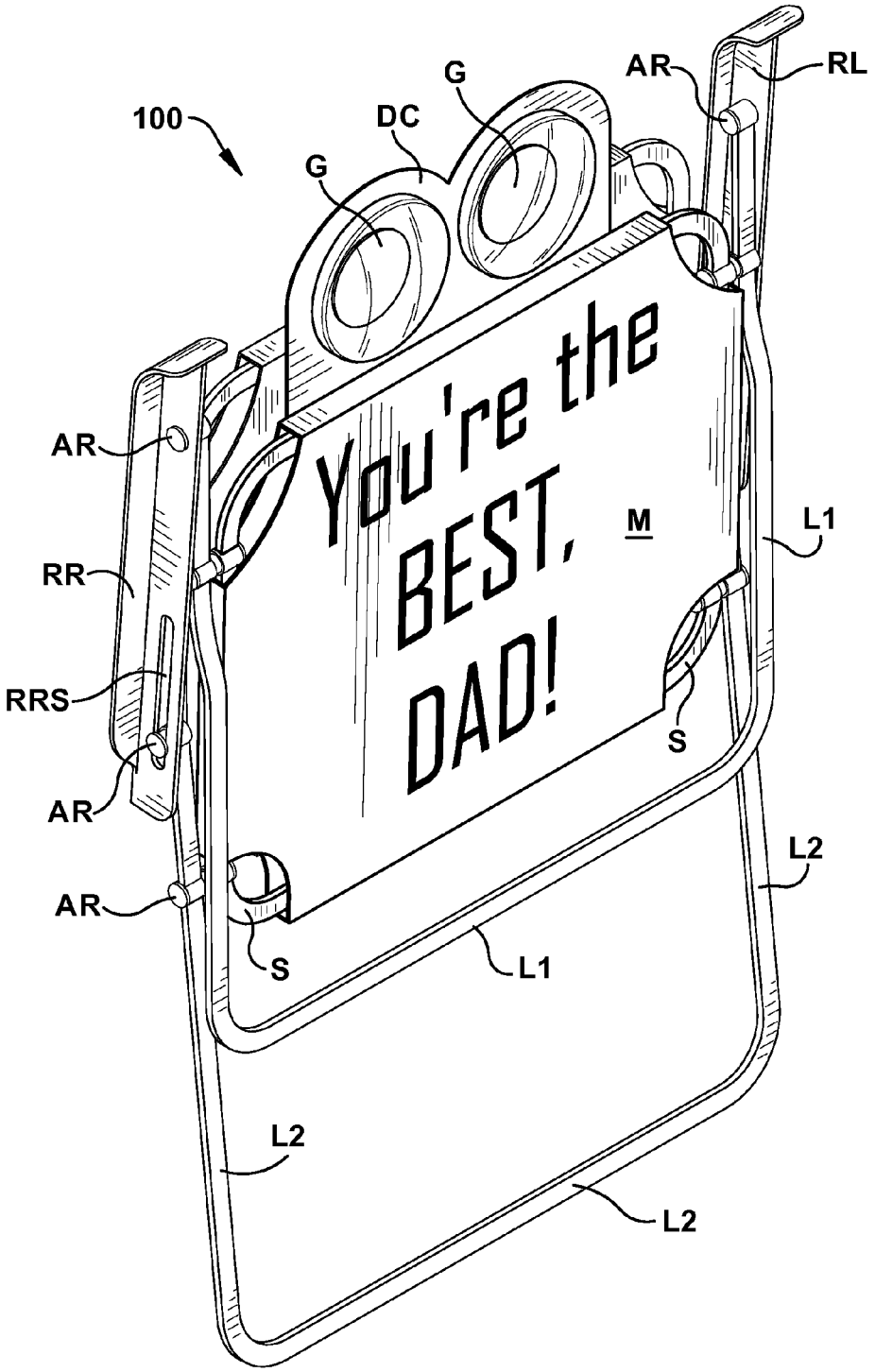
FIG. 1 is a perspective view of the greeting card of the present invention, in a folded or closed position.
Figure 2:
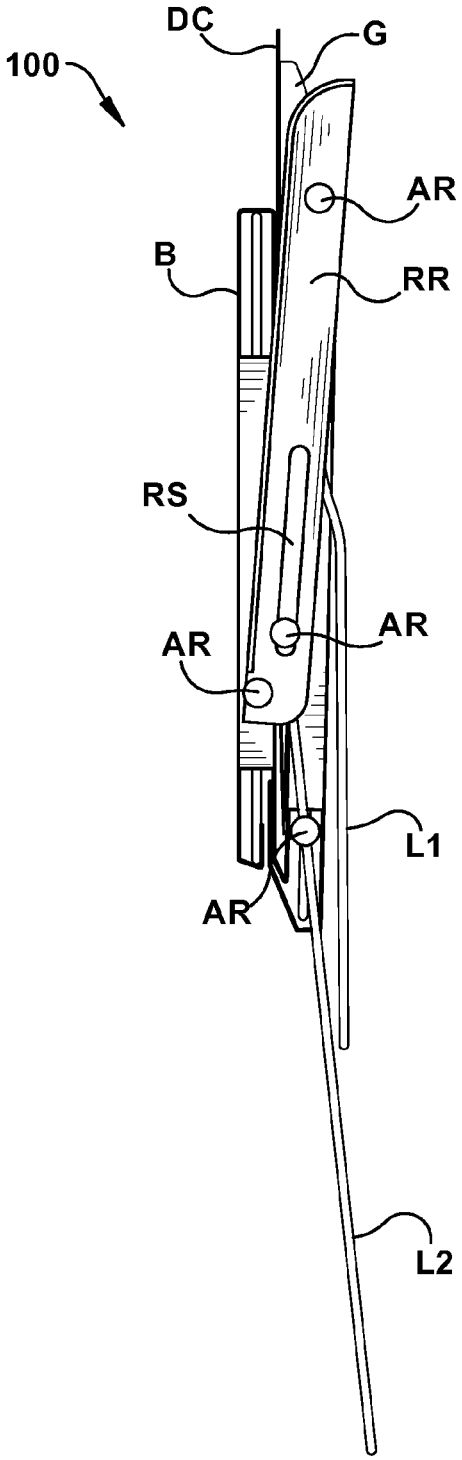
FIG. 2 is a side view of the greeting card of FIG. 1.

At retail, the greeting card 100 (in the folded position) may be contained in a clear plastic poly bag or sleeve which is attached along a fold line to a second plastic poly bag or sleeve which contains the greeting card envelope. A hard, clear plastic backing may also be contained within the poly bag or sleeve which contains the greeting card to protect the greeting card from damage during transport or while being handled by consumers. The bag is clear so consumers can see the greeting card and the text sentiment contained thereon. The greeting card (chair) 100 is folded such that the inside surface of the seat portion S of the chair is folded over and facing (in direct contact with) the inside (or front surface of the back portion B of the chair. As noted above, the text sentiment can be printed on the bottom surface of the covering M over the seat portion S of the chair frame so when the card 100 is folded in the bag, consumers can clearly see the text sentiment printed on the greeting card 100. Also, the googly eyes G peek out from behind the folded seat portion S, as shown in FIG. 1, so that they are visible when the greeting card 100 is in the folded position and so consumers can see the added entertaining features while the greeting card 100 is still in the packaging at retail. The packaging may contain a picture of the unfolded chair printed thereon so that consumers can see how the unfolded greeting card will look. The packaging may also contain a sticker thereon directing the user to the portion of the greeting card 100 containing the press-button 20 so that the consumer can press the button to hear the audio and see the motor movement of the die cut shape DC with googly eyes G attached thereto. Upon purchase, the consumer may remove the greeting card (chair) 100 from the packaging, unfold the chair and sign his/her name and add an optional note or greeting (to either the covering over the chair frame or on the miniature greeting card C attached to the covering M over the seat portion S of the chair frame), re-fold the greeting card (chair) 100 and place it into the envelope, and send or give it to the greeting card recipient. The greeting card recipient can remove the folded greeting card (chair) 100 from the envelope and unfold the greeting card (chair) 100 and press the press-button 20 to hear the audio recording and see the motorized movement of the die cut shape DC and googly eyes G. The press-button 20 operates as a toggle switch so that pressing the press-button 20 a second time with stop the playback of audio and motor movement. In an alternate embodiment, the greeting card 100 may additionally contain a microphone operative to record a personalized user-recorded message that gets played back upon the user pressing the press-button 20. Once the user has read the greeting, he/she may retain the greeting card (chair) 100 as a keepsake or novelty item.

While the greeting card of the present invention has been described herein and shown in the figures as having a particular size and shape, other sizes and shapes of the greeting card have been contemplated and are considered to be within the scope of the present invention. The printing and added features, such as the miniature greeting card, die cut shape and googly eyes (or other such embellishments) can be located anywhere on the greeting card. While the chair frame has been described as being plastic and having a various number of particularly sized openings, the chair may be made of other materials, such as wood, cardboard, aluminum, or any other suitable lightweight material, and the number, size and particular placement of the various openings can be varied. The covering material, while described herein with respect to the preferred embodiment as being made of paperboard, it can alternatively be made of plastic, nylon, cardboard, fabric or any other suitable lightweight and printable material. The various segments of the chair frame can be altered in shape, color, size and appearance, as long as they are combined to form a miniature chair which can be moved between and folded and unfolded position and vice versa. The switch has also been described herein, with respect to the preferred embodiment, as being a press-button switch, however other switch mechanisms can be used, such as a slide tongue switch, a touch sensitive switch, a movement sensitive switch, a sound sensitive switch, a contact switch, or any other suitable switch mechanism. The switch is also described as controlling activation of both the sound module and the motor, however, two separate switches may be used to activate the sound module and the motor.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a chair frame comprising to u-shaped leg portions, a substantially square-shaped seat portion, a substantially square shaped back portion and two arm rests, the chair being moveable between a first position wherein the chair is folded substantially flat and a second position wherein the chair is unfolded and upright, supported by the two u-shaped leg portions;

a planar sheet material which substantially covers the substantially square-shaped seat and back portions of the chair frame.

a sound module operative to store and playback at least one audio file;

a motor operative to cause movement to a mobile object attached to the motor;

a mobile object which is attached to the motor through an opening in the planar sheet material;

a switch operative to activate the sound module and motor module causing playback of the at least one audio file through a speaker and movement of the mobile object.

2. The greeting card of claim 1, further comprising a miniature two panel greeting card attached to the planar sheet material.

3. The greeting card of claim 1, wherein the switch is a press-button switch.

4. The greeting card of claim 3, wherein the press-button switch is accessed through the planar sheet material covering the seat portion of the chair frame.

5. The greeting card of claim 1, wherein the mobile object is a die cut shape.

6. The greeting card of claim 1, wherein the sound module and the motor are concealed beneath the planar sheet material.

7. The greeting card of claim 1 further comprising googly eyes attached to the mobile object.

8. A greeting card comprising:

a foldable miniature chair having a seat portion, a back portion, four legs and two arm rests;

a printable material which covers a substantial portion of the seat and back portions of the foldable miniature chair;

a sound module operative to store and play audio;

a switch which controls activation of the sound module;

a miniature greeting card attached to the printable material.

9. The greeting card of claim 8 further comprising a motor which is operative to cause movement to a mobile object which is attached to the foldable miniature chair.

10. The greeting card of claim 9, wherein the mobile object contains a pair of googly eyes attached thereto.

11. The greeting card of claim 9, wherein the switch also controls activation of the motor.

12. The greeting card of claim 8, wherein the switch is a press-button switch.

13. The greeting card of claim 8, wherein the foldable miniature chair is moveable between a first position wherein it is folded into a substantially flat position and a second position wherein it is unfolded and upright.

14. The greeting card of claim 8, wherein the printable material contains a text greeting printed thereon.

15. A greeting card comprising:

a miniature folding chair which can be moved from a first position wherein it is folded substantially flat and a second position wherein it is unfolded and upright;

a mobile object attached to the folding chair;

a sound module operative to store and playback at least one audio file;

a motor operative to cause movement of the mobile object;

a switch operative to control activation of the sound module and motor;

a planar material attached to the miniature folding chair having text sentiment printed thereon.

16. The greeting card of claim 15, wherein the switch is a press-button switch.

17. The greeting card of claim 15, wherein the planar sheet material covers a seat portion of the miniature folding chair.

18. The greeting card of claim 15, wherein the planar sheet material covers a back portion of the miniature folding chair.

19. The greeting card of claim 15, wherein the planar sheet material covers a seat and a back portion of the miniature folding chair.

20. The greeting card of claim 15 further comprising a miniature two-panel greeting card attached thereto.

* * * * *